US006095772A

United States Patent [19]

Ramey et al.

[11] Patent Number: 6,095,772

[45] Date of Patent: Aug. 1, 2000

[54] SHAFT COUPLING SYSTEM

[75] Inventors: Larry M. Ramey, Fredericktown; Cecil Flynn, Bellville; Shane A. Kinton, Fredericktown, all of Ohio

[73] Assignee: The Gorman-Rupp Company, Mansfield, Ohio

[21] Appl. No.: 09/062,684

[22] Filed: Apr. 20, 1998

[51] Int. Cl.[7] ..... F04B 17/00

[52] U.S. Cl. ..... 417/423.6; 417/360; 417/319

[58] Field of Search ..... 417/423.6, 360, 417/319; 415/124.2; 464/73, 88

[56] References Cited

U.S. PATENT DOCUMENTS

| | | | |
|---|---|---|---|
| 4,063,433 | 12/1977 | Chanton | 64/11 R |
| 4,211,519 | 7/1980 | Hogan | 417/360 |
| 5,019,038 | 5/1991 | Linden | 604/49 |
| 5,482,432 | 1/1996 | Paliwoda et al. | 415/168.2 |
| 5,697,773 | 12/1997 | Mendoza et al. | 418/236 |

*Primary Examiner*—Henry C. Yuen
*Assistant Examiner*—Mahmoud M. Gimie
*Attorney, Agent, or Firm*—Renner, Kenner, Greive, Bobak, Taylor & Weber

[57] ABSTRACT

A shaft coupling system (10) is used to connect one shaft (23) to another shaft (44). The system (10) is suited for use in the environment of a pump (11) having a motor assembly (12) and a disposable pump assembly (13). The shaft (23) is driven by a motor (15) and carries a drive coupling device (24). The shaft (44) of the pump assembly (13) carries an impeller (47) at one end and a driven coupling device (49) at the other end. The drive coupling device (24) includes lugs (55) having helical guide surfaces (57, 58) and a helical drive surface (56). The driven coupling device (49) includes fingers (64) having helical guide surfaces (66, 67) and a helical driven surface (65). When the coupling devices (24, 49) are axially engaged, the guide surfaces (57, 58 and 66, 67) may engage each other and rotate the coupling devices (24, 49) relative to each other to position the fingers (64) between the lugs (55). Rotation of the shaft (23) by the motor (15) causes the drive surface (56) to engage the driven surface (65) which not only couples the shafts (23, 44) but also axially positions the impeller (47) in the pump assembly (13). A housing (14) for the motor (15) includes pins (19) which are received in slots (39) of the pump assembly (13) to attach the motor assembly (12) to the pump assembly (13).

19 Claims, 2 Drawing Sheets

SHAFT COUPLING SYSTEM

TECHNICAL FIELD

This invention relates to a system for coupling a portion of a shaft, such as a motor-driven shaft to a portion of a shaft carried by a device to be driven. More particularly, this invention relates to such a system whereby the device being driven by the motor, such as a pump assembly, can be quickly removed from or attached to the motor by uncoupling or coupling the portion of the shaft carried by the device from or to the portion of the shaft carried by the motor.

BACKGROUND ART

It is often desirable to be able to quickly, without the need for mechanical fasteners and tools, be able to separate, or attach, a motor-driven shaft, from or to, the shaft of a device to be driven by the motor. Such a need exists, for example, in the medical field where pumps are used for surgical purposes, such as the irrigation of a patient. In these situations, for reasons of contamination, the pump must be discarded and replaced with another pump after each use.

In the past, one solution to the problem was to provide a totally disposable pump and motor unit such that after use, the entire unit was discarded. However, such is an expensive practice because the unit, particularly the motor portion thereof, could not inexpensively be made, even though it was intended for disposal. Attempts to reduce the costs of such units were at the expense of reliability, a characteristic which cannot be compromised in the medical, operating room, environment.

The other alternative has been to merely provide permanent motors on site at the hospital or the like, and provide disposable pump units to be attached to the motor shaft for use, and to be thereafter disassembled and discarded. While such assuaged the cost and reliability problems, the attachment of the pump to the motor shaft and the disassembly thereof fostered further problems. Because such required the use of mechanical fasteners and tools, and somewhat of an intricate knowledge of proper shaft coupling, most people, such as someone on the medical staff of a hospital, could not perform, or would not have the time to perform, the procedure. Therefore, each time a pump had to be changed, a mechanic or maintenance person would be needed to perform the task, which could not be performed in a matter of minutes. Thus, this alternative resulted in labor-intensive costs and time-consuming delays.

Thus, the need exists for a system to be able to quickly connect, or disconnect, a pump or other device to, or from, a motor-driven shaft.

DISCLOSURE OF THE INVENTION

It is thus an object of the present invention to provide a system of coupling a device to, and uncoupling a device from, a motor-driven shaft.

It is another object of the present invention to provide a system, as above, in which a portion of the shaft is carried by the motor and another portion of the shaft is carried by the device, the system coupling the two shaft portions.

If is a further object of the present invention to provide a system, as above, in which the shaft portions are self-aligning during the operation of the coupling procedure.

It is an additional object of the present invention to provide a system, as above, in which the shaft portions are self-locking upon activation of the motor.

It is a still further object of the present invention to provide a system, as above, in which the length of the coupled shaft portions is fixed upon completion of the coupling procedure.

It is yet another object of the present invention to provide a system, as above, in which the device is a pump and its shaft portion carries an impeller, the impeller being properly axially positioned upon completion of the coupling procedure.

It is still another object of the present invention to provide a system, as above, which can be operated quickly and easily without the need for any tools or fasteners, and which can be manufactured inexpensively.

These and other objects of the present invention, as well as the advantages thereof over existing prior art forms, which will become apparent from the description to follow, are accomplished by the improvements hereinafter described and claimed.

In general, a system for coupling a first shaft portion to a second shaft portion includes a coupling device carried by each shaft portion. Each coupling device has at least one helical surface. The coupling devices are adapted to engage each other such that upon rotation of the coupling devices relative to each other, the helical surfaces engage each other to attach the shaft portions.

In accordance with another aspect of the invention, a system is provided for coupling a shaft portion carried by a motor to a shaft portion carried by another device. The system includes a first coupling device attached to one of the shaft portions and a second coupling device attached to the other of the shaft portions. One of the coupling devices is provided with lugs and the other of the coupling devices is provided with fingers. Upon rotation of the coupling devices relative to each other, the fingers and the lugs engage each other to attach the shaft portions.

A pump made in accordance with the concepts of the present invention includes a motor carrying a shaft and a pump assembly carrying a shaft. A coupling device is provided to attach the shafts. The coupling device includes lugs and fingers such that upon rotation of the motor shaft, the fingers engage the lugs to couple the shafts.

A disposable pump assembly made in accordance with the concepts of the present invention includes a pump chamber having an impeller therein. A pump shaft extends into the chamber and carries the impeller on one end thereof. The other end of the pump shaft extends out of the chamber and carries a shaft coupling device. The configuration of the shaft coupling device is such that it is mateable with a coupling device carried by a motor-driven shaft of a motor, such that upon rotation of the coupling device of the motor-driven shaft relative to the shaft coupling device, the motor-driven shaft is connected to the pump shaft.

A preferred exemplary shaft coupling system incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
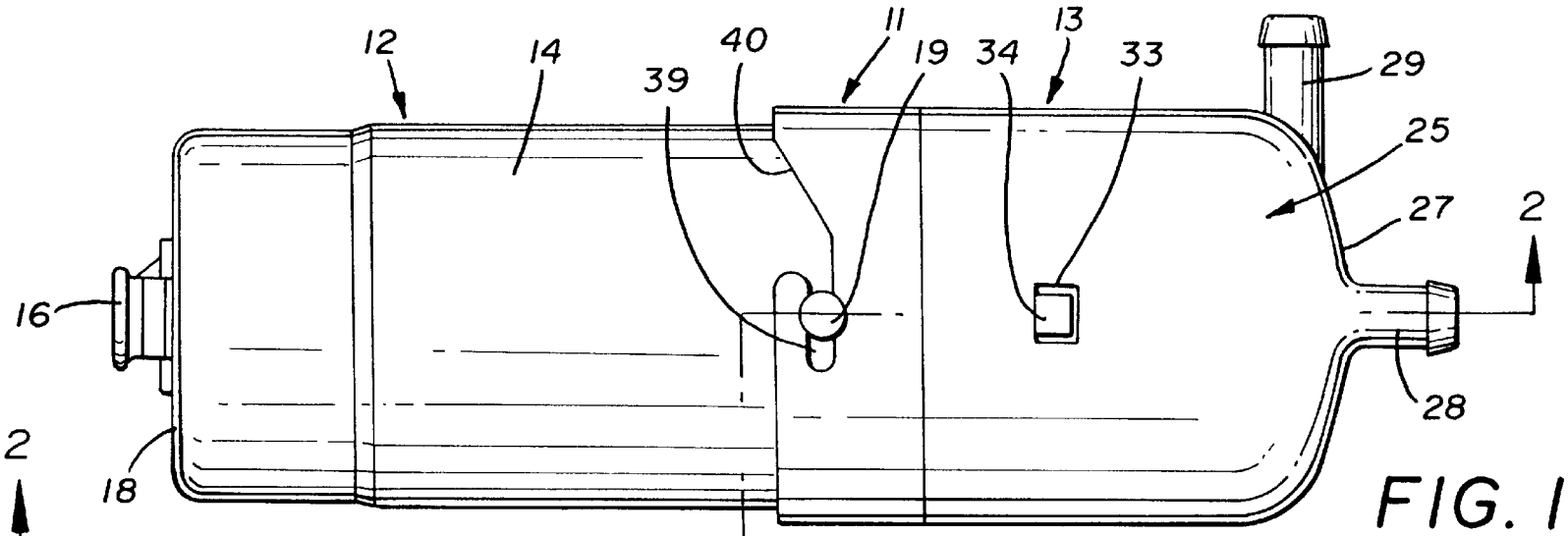
FIG. 1 is an elevational view of a pump having a shaft coupling system made in accordance with the concepts of the present invention.
Figure 2:
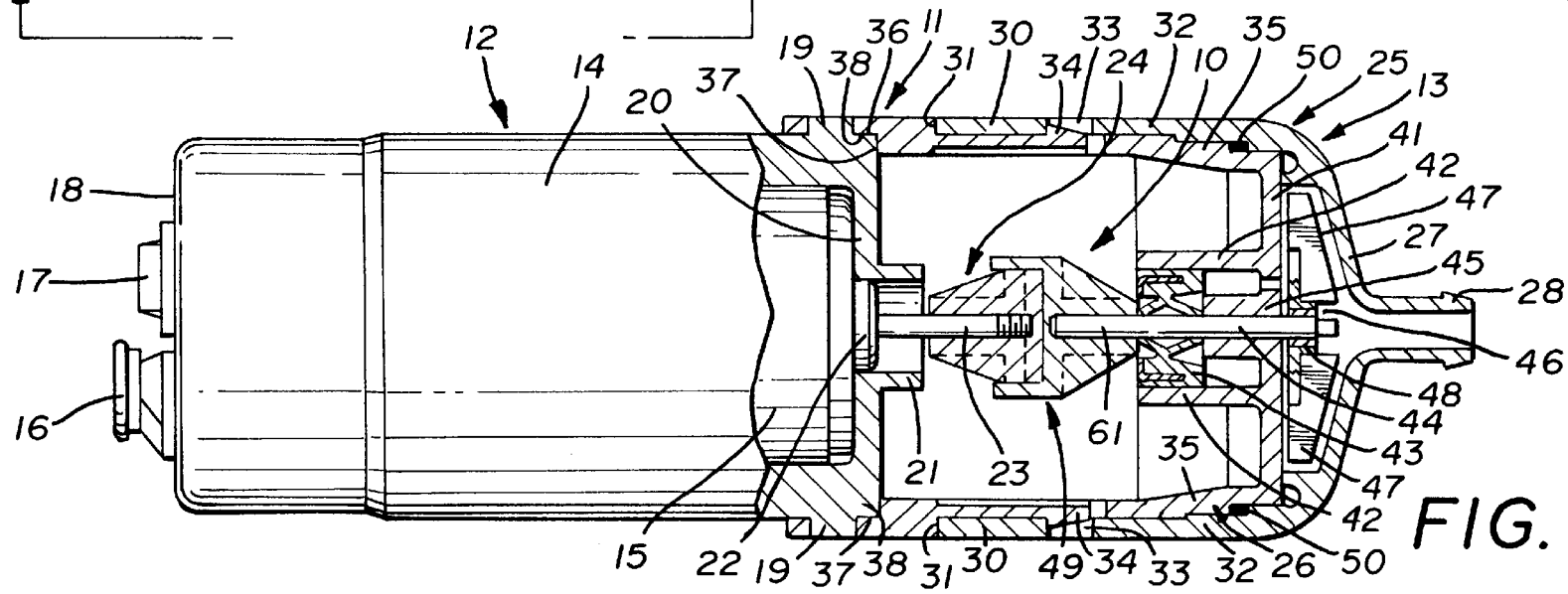
FIG. 2 is a partial elevational view and a partial sectional view taken substantially along line 2—2 of FIG. 1.

A shaft coupling system made in accordance with the present invention is generally indicated by the numeral 10 in the accompanying drawings. As will hereinafter become evident, system 10 can be used to couple shaft components found in any type of device, but is shown as being used in conjunction with a pump generally indicated by the numeral 11. Pump 11 includes a motor assembly, generally indicated by the numeral 12, and a pump assembly, generally indicated by the numeral 13. By virtue of the fact that pump 11 utilizes coupling system 10, pump assembly 13 can be rendered disposable and therefore made from inexpensive components.

Motor assembly 12 includes a generally cylindrical housing 14 having a conventional motor 15 positioned therein. A power jack 16 and on/off switch 17 associated with motor 15 are shown at one end 18 of housing 14 for operation of motor 15. Diametrically opposed pins 19 are positioned on the outer surface of housing 14 near the other end 20 thereof. As will hereinafter be described, pins 18 are provided so that housing 14 may engage pump assembly 13. End 20 of housing 14 is formed with a cylindrical hub 21 into which the front bearing 22 of motor 15 is positioned. Motor 15 drives a motor shaft 23 which extends through hub 21 and into pump assembly 13 when pump assembly 13 is positioned axially adjacent to motor assembly 12. Shaft 23 carries at its outer end, a drive coupling device, generally indicated by the numeral 24, which is a component of coupling system 10.

Pump assembly 13 includes a generally cylindrical casing, generally indicated by the numeral 25, and a generally cylindrical coupling head, generally indicated by the numeral 26. The closed end 27 of casing 25 is formed with an axial fluid inlet port 28 and a tangential fluid outlet port 29. The cylindrical open end 30 of casing 25 is received against a cylindrical shoulder 31 formed in coupling head 26. The sidewall 32 of casing 25 is provided with diametrically opposed slots 33 into which lock barbs 34 formed on the sidewall 35 of coupling head 26 are received. As such, casing 25 is attached to coupling head 26 by sliding casing sidewall 32 over coupling head sidewall 35 until lock barbs 34 snap into slots 33. The open end 36 of coupling head 26 adjacent to motor assembly 12 is formed with a cylindrical shelf 37 to receive a shoulder 38 formed near end 20 of motor housing 14. Open end 36 is of such a diameter to fit around housing 14 of motor assembly 12. At diametrically opposed sides of end 36 of sidewall 32 (one shown in FIG. 1) a slot 39 is formed in sidewall 32 with a beveled edge 40 leading into slot 39. As pump assembly 13 is axially moved onto motor assembly 12, pins 19 may engage beveled edges 40, and upon a clockwise rotation of pump assembly 13, pins 19 are received in slots 39 to lock pump assembly 13 to motor assembly 12.

Coupling head 26 is formed with a generally closed end 41 spaced from casing end 27. A shaft seal housing 42 extends axially inwardly from coupling head end 41 and houses a conventional shaft seal 43 through which a pump shaft 44 is received. Shaft 44 is also received through a sleeve bearing 45 formed at closed end 41 of coupling head 26, and extends into a pump chamber 46 formed between end 41 of coupling head 26 and casing end 27. An impeller 47 having a hub 48 is press fit onto the end of pump shaft 44 and is thereby positioned in pump chamber 46. Shaft 44 carries, at its other end, a driven coupling device, generally indicated by the numeral 49, which is a component of coupling system 10.

With coupling system 10 locking shafts 23 and 44 together, as will hereinafter be described, upon activation of motor 15, fluid may be drawn into pump chamber 46 through inlet port 28 and driven by the rotating impeller 47 out through outlet port 29. Shaft seal 43 and an O-ring seal 50 positioned between pump casing 25 and coupling head 26, assure that the coupling system 10 is not exposed to, or otherwise contaminated by, the fluid being pumped.

Figure 3:
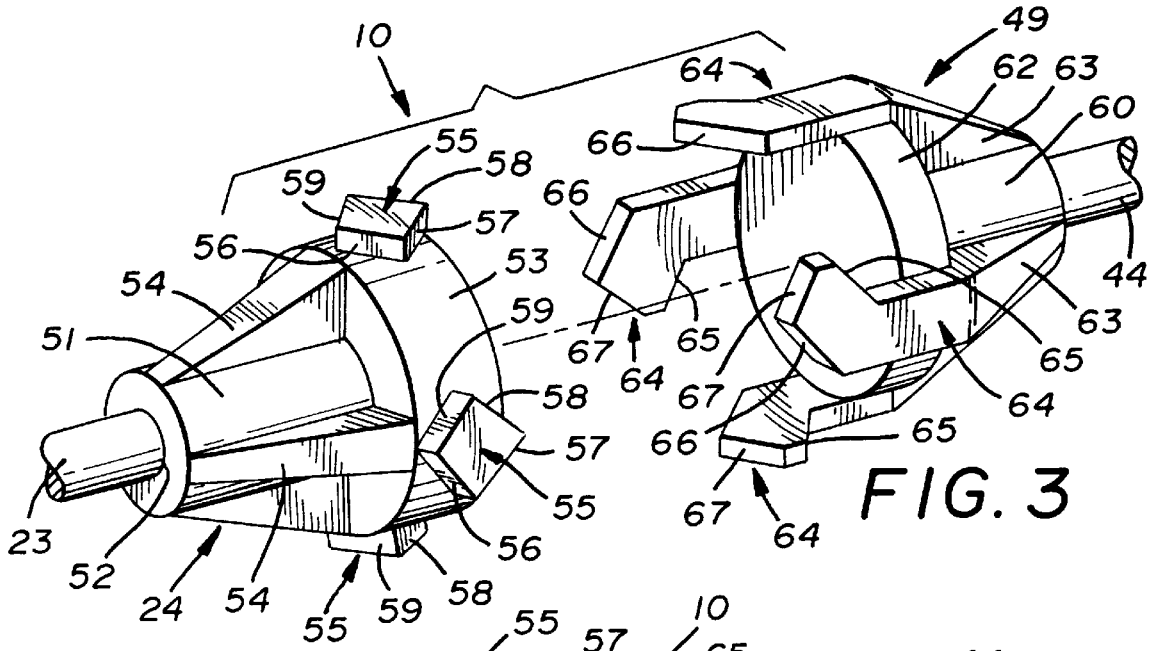
FIG. 3 is a perspective view of the coupling devices of the shaft coupling system, showing the devices separated.
Figure 4:
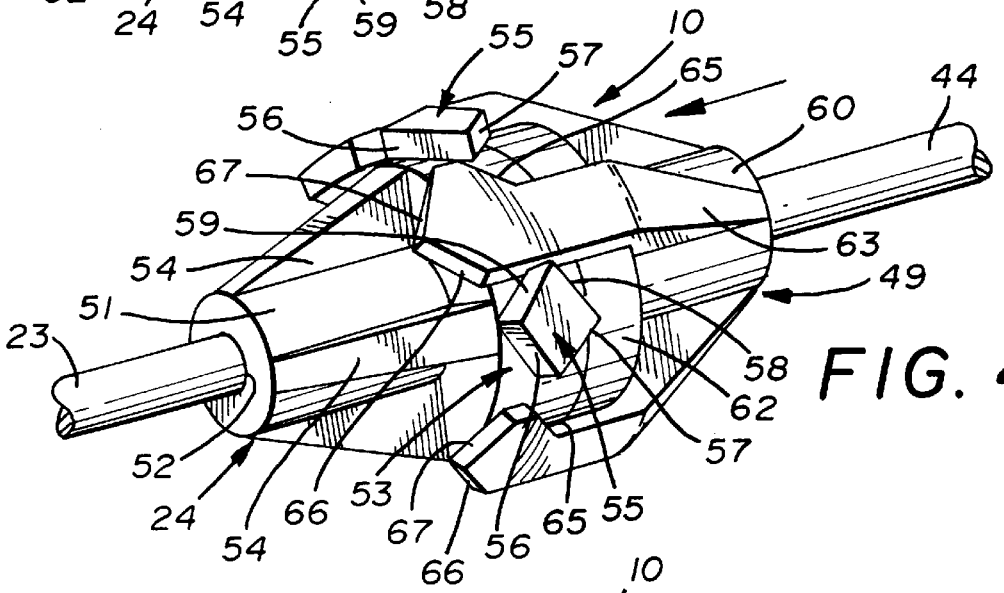
FIG. 4 is a perspective view similar to FIG. 3 but showing the coupling devices having been axially moved relative to each other.

The manner in which drive coupling device 24 and driven coupling device 49 form coupling system 10 is best described with reference to FIGS. 3–5. Drive coupling device 24 includes a cylindrical body member 51 having a bore 52 therein so that coupling device 24 may be press fit onto shaft 23 until the end of shaft 23 reaches the bottom of bore 52. An enlarged collar 53 is formed at the end of body member 51, and a plurality of strengthening ribs 54 may extend from body member 51 to collar 53. A plurality, preferably four, of lugs, generally indicated by the numeral 55, are formed, in equal spacing (ninety degrees of each other for four lugs), around the edge of collar 53. Each lug 55 presents a drive surface 56, two guide surfaces 57 and 58, and a fourth surface 59. At least surfaces 56, 57 and 58 are helical in nature relative to the axis of shaft 23, the helix having a pitch of preferably forty-five degrees.

Driven coupling device 49 includes a cylindrical body member 60 having a bore 61 (FIG. 1) therein so that coupling device 49 may be press fit onto shaft 44 until the end of shaft 44 reaches the bottom of bore 61. An enlarged collar 62 is formed at the end of body member 60, and a plurality of strengthening ribs 63 may extend from body member 60 to collar 62. A plurality, preferably four, of fingers, generally indicated by the numeral 64, extend outwardly from, in equal spacing (ninety degrees of each other for four fingers), the end of collar 62. Each finger 64 is generally of a thickness coinciding with the height of each stud 55 of drive coupling device 24, and includes a driven surface 65, two guide surfaces 66 and 67, and a fourth surface 68. At least surfaces 65, 66 and 67 are helical in nature relative to the axis of shaft 44, the helix matching that of surfaces 56, 57 and 58 of studs 55 of drive coupling device 24, that is, preferably having a pitch of approximately forty-five degrees.

The manner in which the driven coupling device 49 is attached to drive coupling device 24 to unite shafts 23 and 44 will now be described in detail. When in the uncoupled position, such as shown in FIG. 3, the user does not know the relative circumferential orientation of fingers 64 relative to lugs 55. However, such is not important because coupling system 10 is self-aligning. That is, as the driven coupling device 49 is moved axially toward the drive coupling device 24, if each finger 64 happens to be perfectly aligned between two lugs 55, the fingers 64 will fit between lugs 55 as shown in FIG. 4. If, however, as would usually be the case, such alignment does not exist, as driven coupling device 49 is moved axially toward drive coupling device 24, helical guide surfaces 66 of fingers 64 may engage helical guide surfaces 58 of lugs 55, or helical guide surfaces 65 of fingers 64 may engage helical guide surfaces 57 of lugs 55. As such, the helical surfaces readily convert the axial force to a tangential force causing coupling devices 24 and 29 to rotate relative to each other to the FIG. 4 position. At this time, rotation of pump assembly 13 relative to motor assembly 12 causes pins 19 to be received in slots 39, as previously described.

Figure 5:
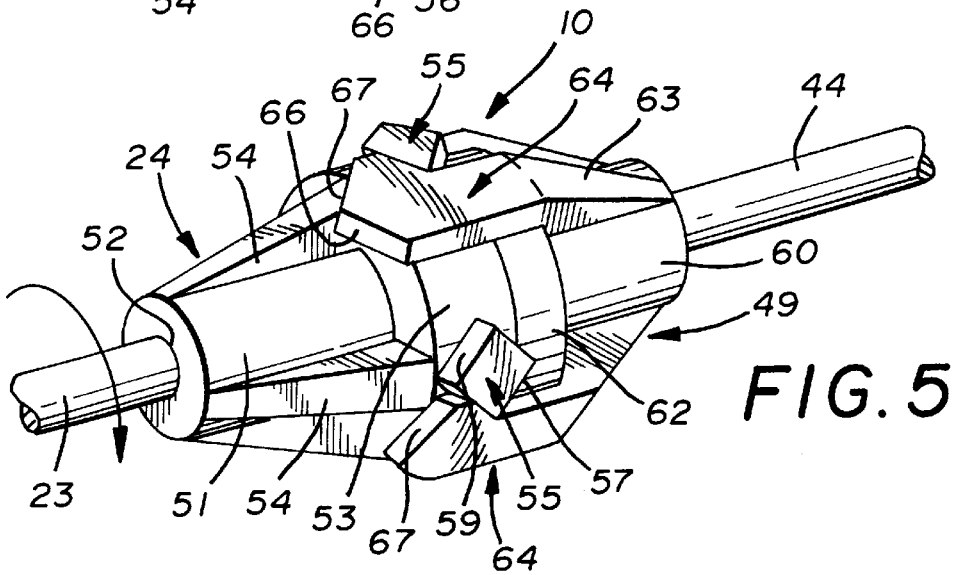
FIG. 5 is a perspective view similar to FIG. 4 but showing the coupling devices in a locked position after one of the coupling devices has been rotated relative to the other.

Pump 11 is now ready for use and upon activation of motor 15 to turn shaft 23, in the direction of the arrow in FIG. 5, drive coupling device 24 is locked to driven coupling device 49, as shown in FIG. 5. The tangential forces of such rotation cause helical drive surfaces 56 of lugs 55 to engage helical driven surfaces 65 of fingers 64, which forces are thereby converted to axial forces such that collar 53 of drive coupling device 24 abuts against collar 62 of driven coupling device 49 to thereby establish, and fix, the length of the mated shafts 23 and 42. As such, impeller 47 is properly positioned in chamber 46 for efficient pump operation.

Shafts 23 and 44 will remain coupled until motor 15 is turned off. At that time, by rotating pump assembly 13 counterclockwise relative to motor assembly 12, pins 19 are moved out of slots 39 and pump assembly 13 may be pulled axially away from motor assembly 12. During such axial movement, axial interference between fingers 64 and lugs 55 causes relative rotations between driven coupling device 49 and drive coupling device 24, by the reverse engagement of the helical surfaces, as previously described, and shafts 23 and 44 are thereby readily uncoupled. As such, if pump assembly 13 has been used to pump a contaminated fluid, as would be the case in a medical environment, for example, pump assembly 13 can be discarded and a new pump assembly 13 attached to the motor assembly 12.

It should thus be evident that a coupling system 10 manufactured and operated as described herein, accomplishes the objects of the present invention and otherwise substantially improves the shaft coupling art.

What is claimed is:

1. A pump comprising a motor, a shaft carried by said motor, a pump assembly, a shaft carried by said pump assembly, and a device for coupling said shafts, said device including lugs and fingers, said lugs and said fingers being configured such that only upon activation of said motor to rotate said motor shaft, said fingers engage said lugs to couple said shafts.

2. A pump according to claim 1 wherein said device includes a first coupler carried by said motor shaft, said first coupler carrying said lugs, and a second coupler carried by said pump assembly shaft, said second coupler carrying said fingers.

3. A pump according to claim 2 wherein said fingers and said lugs are configured such that upon axial movement toward and away from each other, said fingers and said lugs will rotate relative to each other.

4. A pump according to claim 3, wherein said lugs include guide surfaces and aid fingers include guide surfaces, said guide surfaces of said fingers being engageable with said guide surface of said lugs to rotate said fingers and said lugs relative to each other.

5. A pump according to claim 4 wherein said guide surfaces are helical.

6. A pump according to claim 2, said pump assembly including a pump chamber, and an impeller on said pump assembly shaft and positioned in said pump chamber, said lugs including a drive surface, said fingers including a driven surface, said drive surface engaging said driven surface to couple said shafts and to axially position said impeller in said pump chamber.

7. A pump according to claim 6 wherein said drive surface is helical and said driven surface is helical.

8. A pump according to claim 1 further comprising a housing for said motor, a least one pin on said housing, and at least one slot in said pump assembly, said pin being received in said slot when said pump assembly is rotated relative to said housing.

9. A pump assembly according to claim 1 wherein said pump assembly includes a casing, and a coupling head attached to said casing.

10. A pump according to claim 9 further comprising at least one slot in said casing and at least one barb carried by said coupling head, said barb being received in said slot to connect said casing to said coupling head.

11. A pump according to claim 9 further comprising a housing for said motor, at least one pin on said housing, and a slot formed in said coupling head, said coupling head being received around said housing such that upon rotation of said coupling head relative to said housing, said pin is received in said slot.

12. A pump according to claim 9 further comprising a pump chamber between said casing and said coupling head, and an impeller on said pump assembly shaft, said impeller being axially positioned in said chamber when said shafts are coupled.

13. A disposable pump assembly for use with a motor having a driven shaft and a coupling device of a predetermined configuration on the driven shaft, comprising a pump chamber, an impeller in said pump chamber, a pump shaft extending into said pump chamber and carrying said impeller at one end thereof, the other end of said pump shaft extending out of said pump chamber, and a shaft coupling device carried by said other end of said pump shaft, said shaft coupling device being of a predetermined configuration so as to be mateable with the predetermined configuration of the coupling device of the driven shaft, such that only upon activation of the motor to rotate the coupling device of the driven shaft relative to said shaft coupling device, the driven shaft is connected to said pump shaft.

14. A disposable pump assembly according to claim 13 further comprising a pump casing and a coupling head attached to said pump casing, said pump casing and said coupling head defining said pump chamber.

15. A disposable pump assembly according to claim 14, the motor being disposed within a housing having pins extending therefrom, and further comprising slots formed in said coupling head, said coupling head being received around the housing such that upon rotation of said coupling head relative to the housing, the pins are received in said slots.

16. A disposable pump assembly according to claim 14 further comprising at least one slot in said casing and at least one barb carried by said coupling head, said barb being received in said slot to connect said casing to said coupling head.

17. A disposable pump assembly according to claim 13 wherein the predetermined configuration of the coupling device of the driven shaft and the predetermined configuration of said shaft coupling device automatically align the coupling device of the driven shaft with said shaft coupling device.

18. A disposable pump assembly according to claim 13 wherein the predetermined configuration of the coupling device of the driven shaft and the predetermined configuration of said shaft coupling device axially positions said impeller in said pump chamber.

19. A disposable pump assembly according to claim 13 wherein the predetermined configuration of the coupling device of the driven shaft includes lugs having helical surfaces and the predetermined configuration of said shaft coupling device includes fingers having helical surfaces, the lugs engaging said fingers upon mating of the coupling device of the driven shaft with said shaft coupling device.

* * * * *